US008438884B1

(12) United States Patent
Bertrand

(10) Patent No.: US 8,438,884 B1
(45) Date of Patent: May 14, 2013

(54) PADLOCK PROTECTIVE COVER

(76) Inventor: Carl Bertrand, Angus (CA)

( * ) Notice: Subject to any disclaimer, the term of this patent is extended or adjusted under 35 U.S.C. 154(b) by 0 days.

(21) Appl. No.: 13/507,546

(22) Filed: Jul. 9, 2012

Related U.S. Application Data

(60) Provisional application No. 61/633,398, filed on Feb. 10, 2012.

(51) Int. Cl.
*E05B 67/38* (2006.01)

(52) U.S. Cl.
USPC ..... 70/54; 70/55; 70/56; 70/DIG. 43; 70/DIG. 56; 206/462; 206/469; 206/470

(58) Field of Classification Search ..... 70/54–56, 70/417, DIG. 43, DIG. 56, 200, 203, 212, 70/423, 424, 455; 206/462, 469, 470; D8/346
See application file for complete search history.

(56) References Cited

U.S. PATENT DOCUMENTS

| | | | | | |
|---|---|---|---|---|---|
| 256,902 | A | | 4/1882 | Kirk | |
| 416,433 | A | | 12/1889 | Wilson | |
| 547,550 | A | | 10/1895 | Hopkins | |
| 626,266 | A | * | 6/1899 | Bomberger | 70/56 |
| 1,055,865 | A | | 3/1913 | Boll | |
| 1,136,582 | A | | 4/1915 | Birdsong | |
| 1,220,941 | A | | 3/1917 | Bower | |
| 1,244,404 | A | | 10/1917 | Ankovitz | |
| 1,429,105 | A | | 9/1922 | Rudy | |
| 1,917,973 | A | | 7/1933 | Hughes | |
| 2,096,568 | A | | 10/1937 | Snively | |
| 2,114,913 | A | | 4/1938 | Crossman | |
| 4,033,155 | A | | 7/1977 | De Lucia | |
| 4,033,156 | A | | 7/1977 | Cottingham | |
| 4,154,072 | A | | 5/1979 | Flaschar | |
| 4,286,445 | A | | 9/1981 | Sills | |
| 4,295,350 | A | * | 10/1981 | Grinage | 70/454 |
| 4,297,861 | A | * | 11/1981 | Dykes | 70/55 |
| 4,535,612 | A | | 8/1985 | Seremet | |
| 4,566,296 | A | | 1/1986 | Kochakis | |
| 4,858,454 | A | | 8/1989 | McAnulty | |
| 4,905,486 | A | | 3/1990 | Appelbaum | |
| 4,926,662 | A | | 5/1990 | Gaudet | |
| 5,003,795 | A | | 4/1991 | Hoke | |
| 5,168,258 | A | * | 12/1992 | Radke | 340/542 |
| 5,218,846 | A | | 6/1993 | Cook | |
| 5,239,132 | A | * | 8/1993 | Bartow | 174/58 |
| 5,275,028 | A | | 1/1994 | Giarrante | |
| 5,307,653 | A | | 5/1994 | Davis | |
| 5,477,710 | A | * | 12/1995 | Stefanutti | 70/56 |
| D369,090 | S | | 4/1996 | Santos | |
| 5,875,659 | A | | 3/1999 | Nosse | |
| 5,934,113 | A | | 8/1999 | Loughlin | |
| 5,975,595 | A | * | 11/1999 | Lorenzo | 292/205 |
| 6,058,745 | A | | 5/2000 | Sanchez | |
| 6,182,479 | B1 | * | 2/2001 | Daoud | 70/2 |
| 6,192,721 | B1 | | 2/2001 | Monteleone | |
| 6,439,008 | B1 | | 8/2002 | Keil | |
| 6,578,393 | B2 | | 6/2003 | Yarborought | |
| 6,581,419 | B1 | * | 6/2003 | Strodtman | 70/56 |

(Continued)

*Primary Examiner* — Lloyd Gall
(74) *Attorney, Agent, or Firm* — Pinsky Law

(57) ABSTRACT

A protective cover for an outdoor padlock or another lock which secures a hasp to a door, has a base, a housing dimensioned to accommodate the lock and the hasp, and a flexure hinge, preferably a living hinge. When the base of the protective cover is attached to the door protected by the padlock, the housing abuts and presses against the door.

7 Claims, 4 Drawing Sheets

U.S. PATENT DOCUMENTS

| | | | | |
|---|---|---|---|---|
| 6,622,533 | B1 * | 9/2003 | Santini | 70/56 |
| 7,278,284 | B1 * | 10/2007 | James | 70/56 |
| 7,412,856 | B1 * | 8/2008 | Gogel | 70/56 |
| 7,947,901 | B2 | 5/2011 | Leopold | |
| D640,911 | S | 7/2011 | Yang | |

* cited by examiner

PADLOCK PROTECTIVE COVER

CROSS-REFERENCE TO RELATED APPLICATIONS

This application claims the benefit of U.S. Provisional Application No. 61/633,398 filed Feb. 10, 2012, which is hereby incorporated by reference in its entirety.

FIELD OF THE INVENTION

This invention relates to the field of covers for locks such as padlocks, cylinder locks, combination locks, flush-mounted locks, or other security devices, and more specifically to weatherproof covers for outdoor padlocks or combination locks to provide protection of such locks from contamination caused by precipitation, dust, dirt, moisture, spray, and the like.

BACKGROUND OF THE INVENTION

Outdoor padlocks and combination locks are a common form of security devices for doors. Outdoor padlocks and outdoor combination locks are exposed to dust, dirt, and weather elements, such as precipitation, that are harmful to the locks. Therefore, outdoor padlocks require some sort of weatherproof protective cover, otherwise they might become contaminated with dirt, moisture or ice. Dirt and moisture can invade a padlock through a keyhole, or through the interface of the shackle with the padlock body, and can significantly damage the padlock and impair its performance. Once dirt and moisture penetrate a padlock, the padlock may start to rust and its working mechanism may become inoperative, especially if frozen. After the lock rusts or corrodes, a key may no longer fit properly into the padlock keyhole, or a key may not turn the mechanism. Also, a shackle may not slip off its lock interface once internal corrosion has taken place. Further, when a padlock is exposed to freezing temperatures after being invaded by a liquid such as water, the padlock generally freezes shut so that it cannot be opened until its temperature rises above the melting point. Sometimes a padlock will never open or work properly again after such damage. Therefore, both consumers and padlock manufacturers are concerned with the negative impact of dirt, debris and weather elements on outdoor padlocks and combination locks.

To counteract the abovementioned problems, padlock protective covers have been designed for several years, the covers made of a plastic, metal, as well as recycled tire rubber. Typically, such a cover has a housing and a hinged flap that is sized to cover the padlock. The housing can be attached to a door that is secured by the padlock. Examples of lock protective covers can be found in U.S. Pat. Nos. 256,902; 416,433; 1,055,865; 1,136,582; 1,244,404; 1,248,293; 4,033,156; and 4,926,662.

While the prior-art protective covers serve each its purpose to a degree, most of them have one or more disadvantages in that they do not cover the padlock sufficiently on all sides which allows water to seep in between the housing of the protective cover and the door the housing is attached to, thus permitting the water to reach the padlock. Once water is able to penetrate the cover and reach the padlock, it can potentially cause contamination of the padlock. Because of water splashing during a heavy rain or due to wind, water can enter an outdoor padlock from almost any angle. There is still a need for a device that will protect a padlock from exposure to the elements from all sides, yet permit an easy and convenient access to the padlock.

SUMMARY OF THE INVENTION

In accordance with the invention, there is provided a padlock protective cover that comprises a base having attachment means for attaching the base to a substrate in a vicinity of a padlock to be covered, a housing having a substantially planar periphery, the housing shaped and dimensioned to accommodate the padlock therein when the housing abuts the substrate around the padlock along the periphery, and a strip of flexible material, also known as a flexure hinge, connected to the base and to the housing to allow a pivotal movement of the housing relative to the base.

In an embodiment of the invention, the flexure hinge is a living hinge which is integral with the base and the portion, for example co-extruded or co-stamped therewith.

In an embodiment of the invention, where the padlock or another lock engages a hasp and a staple and immobilizes the hasp against a structure such as a door, the housing has at least one cutout-ready portion at the periphery of the housing to enable formation of a cutout at a position corresponding to the hasp and sized to accommodate the hasp, so that in a closed position of the cover, the housing abuts the door along most of the periphery of the housing.

The term "living hinge" denotes herein a structure capable of undergoing flexible or, preferably, resilient deformation when a force is applied thereto, wherein the hinge, when the deformation-causing force is withdrawn, returns at least partly to the original position.

In an embodiment of the invention, the cover including the base, housing and the living hinge, is made of a water-resistant, mildew-resistant, rust-resistant, UV protected, and durable polymer.

The cutout-ready portion(s)s of the housing are preferably adapted to be partially removed, typically by the user of the cover, using a tool such as a knife or scissors. To this end, the cutout-ready portion may have a thinned wall, or a wall provided with perforations or indentations to facilitate removing a part of the wall corresponding to the cross-sectional dimensions of the hasp. When the padlock engages a hasp and a corresponding cutout (or two cutouts) are made in the casing to accommodate the hasp as illustrated and described hereinbelow, the casing should cover the padlock on all sides except the substrate (e.g. a door) so as substantially prevent ingress of water, snow, etc. into the padlock.

BRIEF DESCRIPTION OF THE DRAWINGS

The objects and advantages of the present invention will become apparent from the following description of exemplary embodiments thereof in conjunction with the drawings, in which like numerals depict like parts in the several views, and in which:

FIG. 5 is a cross-sectional view of the protective cover of FIGS. 3 and 4, and.

It is noted that the drawings illustrate only a preferred embodiments of the invention and are therefore not to be considered limiting of its scope, for the invention may admit of other equally effective embodiments.

DETAILED DESCRIPTION OF EMBODIMENTS OF THE INVENTION

Figure 1:
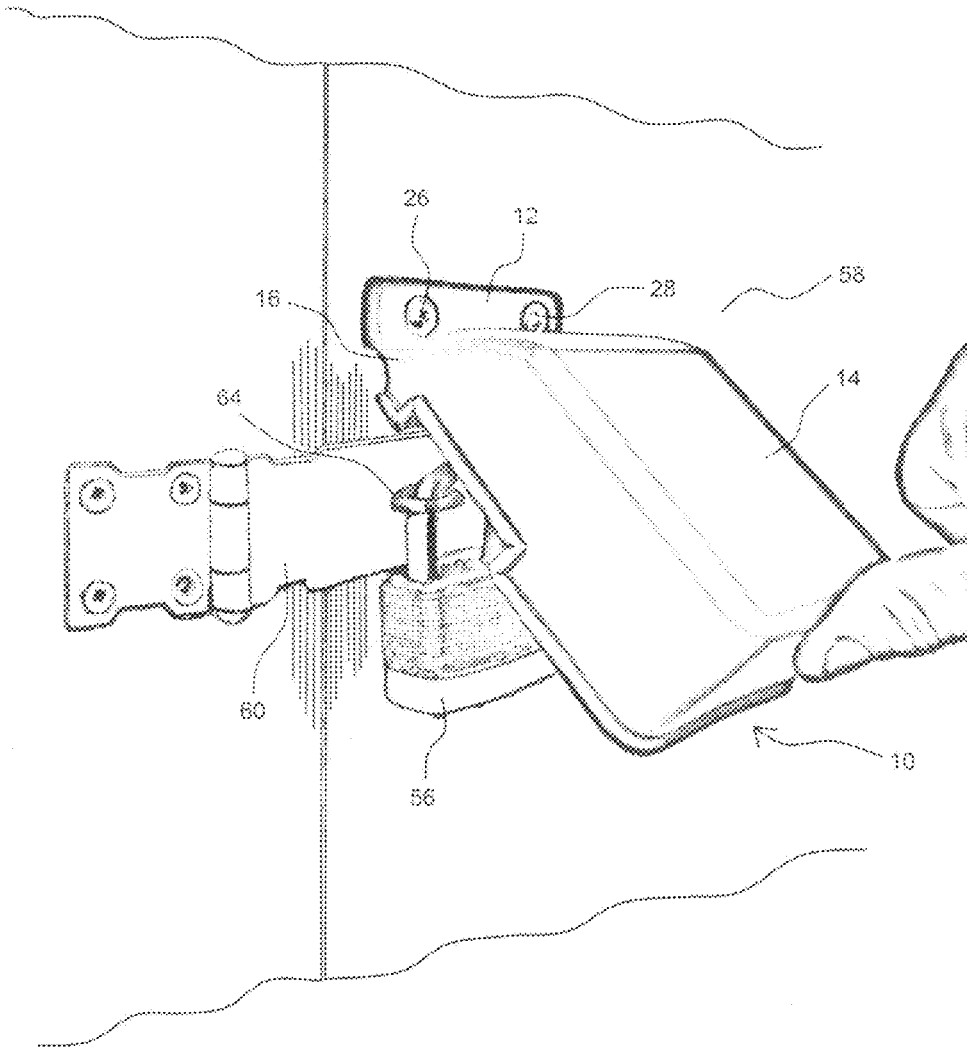
FIG. 1 is a perspective view of a protective cover according to the present invention, the cover mounted over a padlock.
Figure 2:
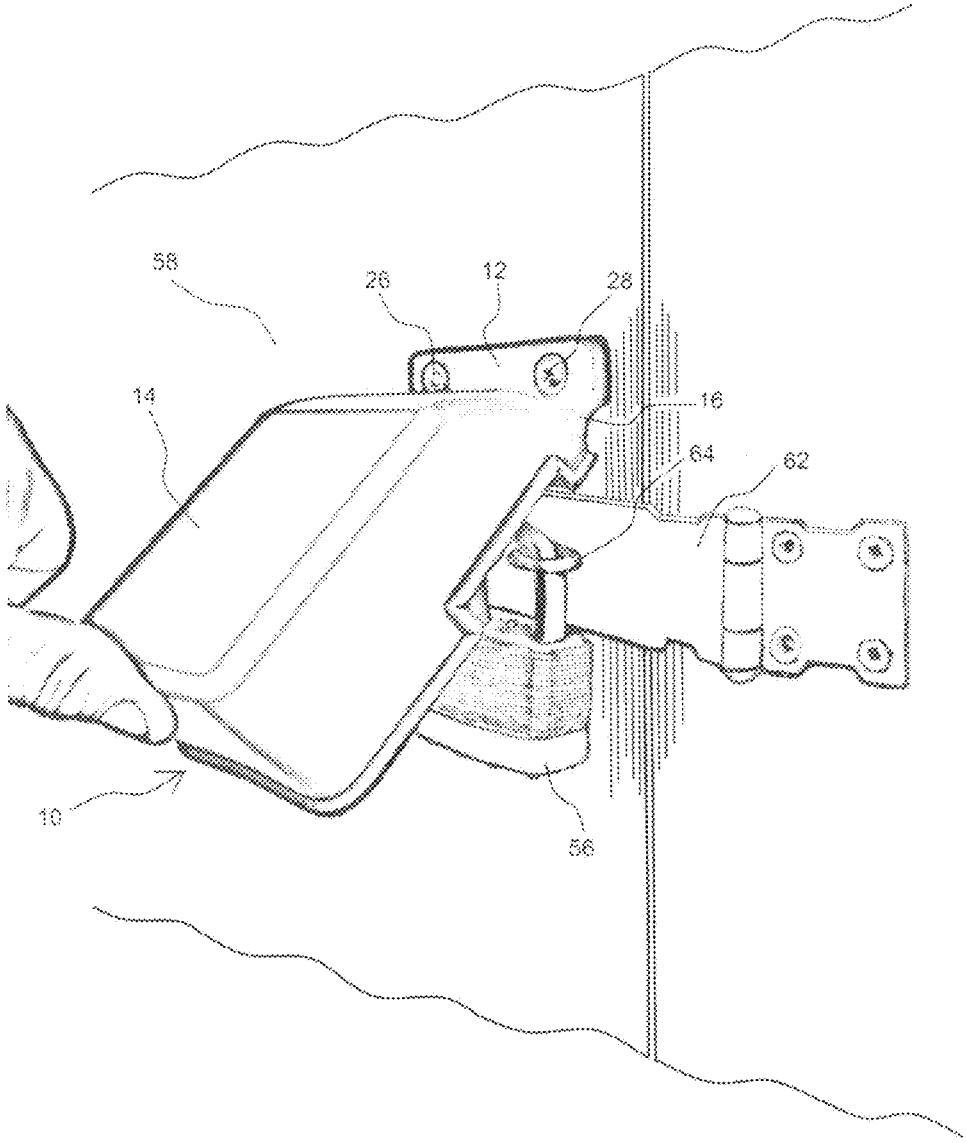
FIG. 2 is another perspective view of the protective cover as mounted over a padlock.

Referring particularly to FIG. 1 and FIG. 2, the cover of the invention, designated generally (10), is shown in a partially open position. The cover has a base (12), a housing (14) and a flexure hinge (living hinge) (16) which are all extruded in one piece and made of a water-resistant, mildew-resistant, rust-resistant, UV protected, and durable polymer. The dimensions of the housing, particularly the thickness, should be selected to exhibit some flexibility of the housing so that in a closed position, the housing adheres reasonably well to a substrate to protect a padlock (56) against elements. The material of the cover may be e.g. an elastomeric material such as a closed-cell foam resin or a solid polymer, including, but not limited to, acrylonitrile-butadiene (NBR) or styrenebutadiene (SBR) or caboxylated derivatives of such butadienes.

Referring now generally to FIGS. 1 through 6, the base (12) of the protective cover (10) has two fastener bores (18) and (22) with respective bore ledges (20) and (24). The base (12) can be attached to a door (58) by means of fasteners (26), (28). The door (58) has a hasp (60) and (62) which can swing to the left or to the right (FIG. 1 or FIG. 2) to engage a staple (64). The padlock (56) has a shackle (70) which engages the staple (64).

As stated above, the protective cover (10) has a three-dimensional housing (14) (FIG. 3) adapted to envelop the padlock (56) when abutting against the structure (e.g. a door (58) that the padlock is associated with. The housing (14) defines a container having a ramp wall (30), a top wall (32), a back wall (34), a first side wall (36), and a second side wall (38). The ramp wall (30), the back wall (34), the first side wall (36), and the second side wall (38) are extending from the top wall (32). The first side wall (36) has a thinned portion (40). The portion (40) is sized to be larger than a cross-sectional dimension of a typical hasp (60) (FIGS. 1, 2 and 6), so that a user, when installing the cover over an existing padlock/hasp combination, can remove a suitable part of the thinned portion (40) corresponding to the hasp dimension. The resulting cut-out should accommodate the hasp as shown in FIGS. 1 and 2. Indentations or perforations (41) may be provided to facilitate the preparation of such a custom-sized cut-out.

Figure 3:
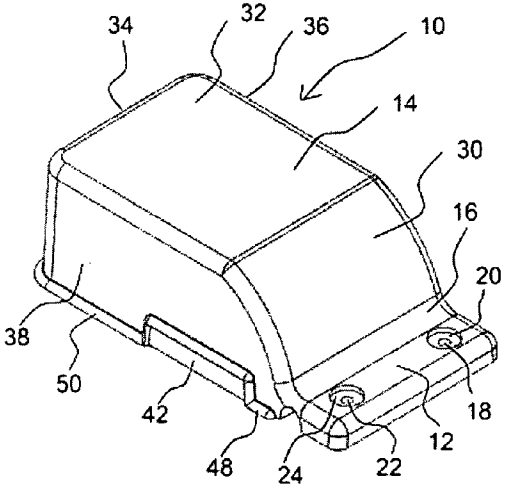
FIG. 3 is a perspective view of the protective cover before mounting.
Figure 4:
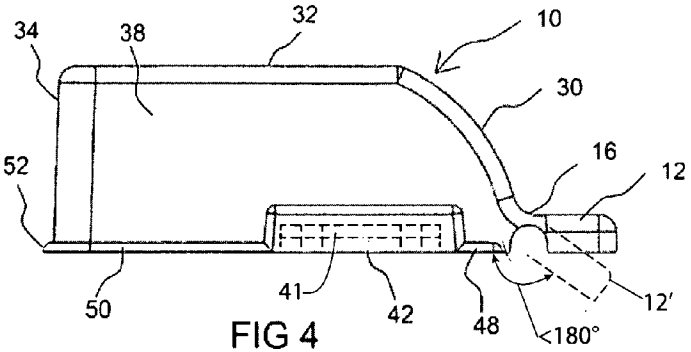
FIG. 4 is a side elevation view of the protective cover of FIG. 3.
Figure 5:
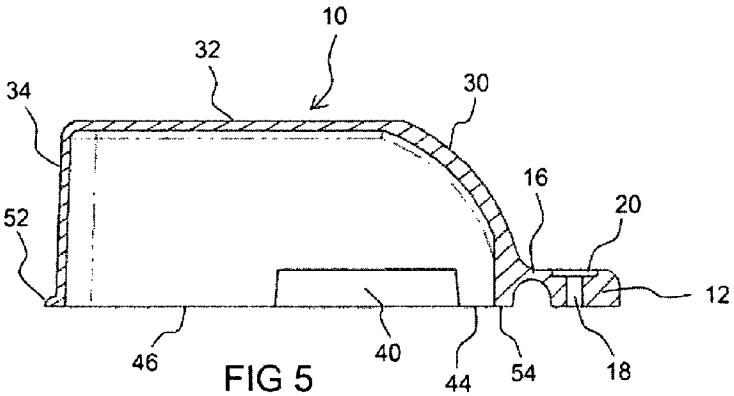

Since doors can open either to the left or to the right (FIG. 1 and FIG. 2), and it is possible that a hasp will extend on both sides of the housing, two cutout-ready portions (40) and (42) can be provided as seen in FIGS. 3, 4 and 5.

The first side wall (36) of the housing (14) has a first ledge (44) and a second ledge (46). The second side wall (38) of the housing (14) has a first ledge (48) and a second ledge (50). The back wall (34) has a ledge (52). The ramp wall (30) of the housing (14) has an edge (54), see FIG. 5. The ledges and the edge (54) define a substantially planar periphery of the housing and serve to reinforce the housing, while allowing some flexibility thereof, and protect the housing from excessive wear.

The material used to construct the base (12), the housing (14), and the flexible connector (16) should be strong, flexible, and resilient. The base (12), the housing (14), and the flexible connector (16) of the protective cover (10) may be comprised of any material known in the art capable of meeting these characteristics. For example, any elastomeric material such as a closed-cell foam resin or solid polymer composition, including, but not limited to, acrylonitrile-butadiene (NBR) or styrenebutadiene (SBR) or caboxylated derivatives of such butadienes (all merely as examples) will meet the requirements of strength, flexibility, and resiliency when suitable dimensions, mainly thickness, are selected.

Figure 6:
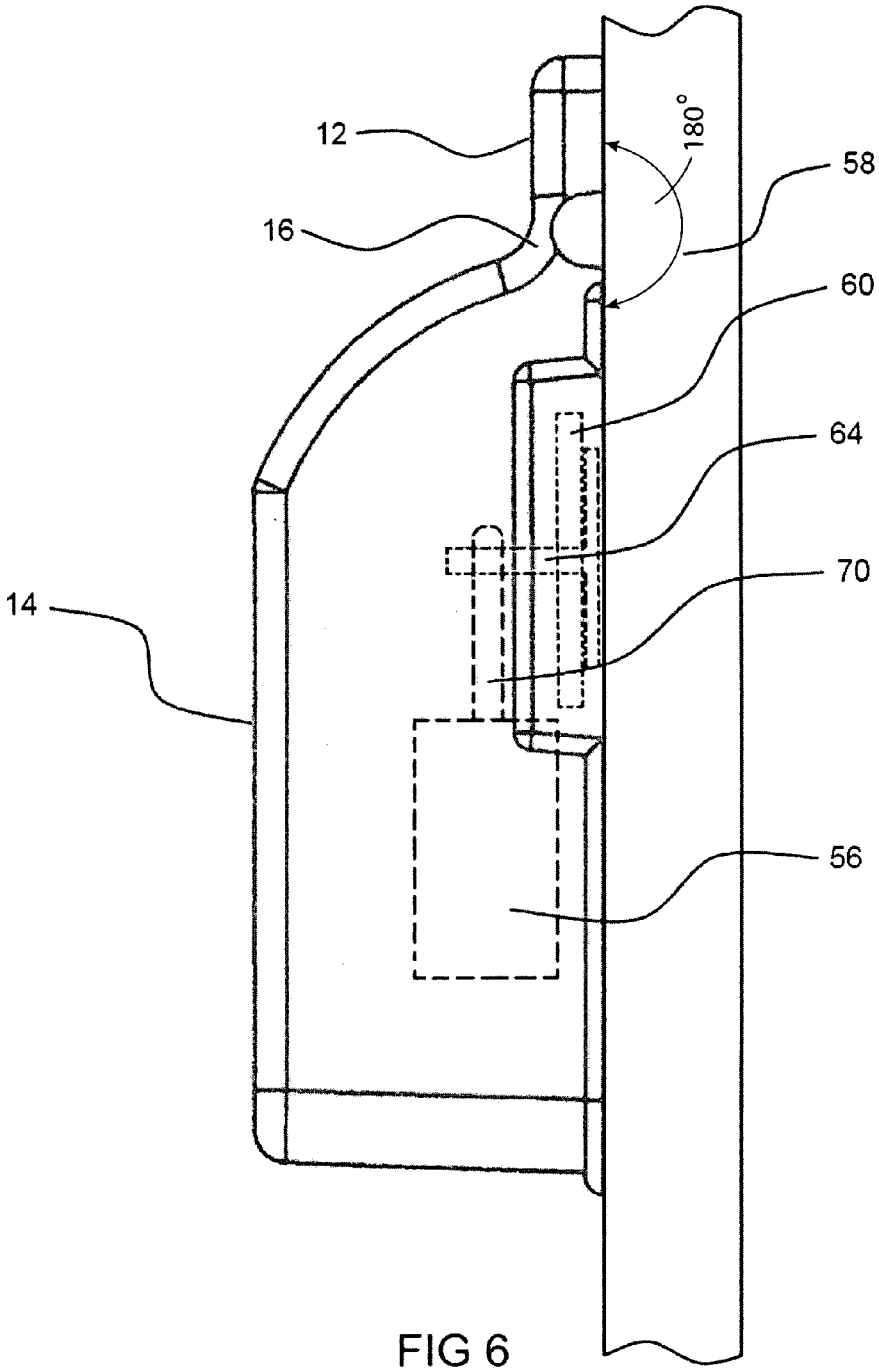
FIG. 6 is a side elevation view of the protective cover of FIG. 4 in its operational closed position in which the base is secured to the substrate, wherein a staple engaged by padlock (shown in phantom lines) is enclosed within the housing of the protective cover.

FIG. 1 and FIG. 2 show the cover in an open position, while FIG. 3 and FIG. 6 show the cover in a closed position, wherein the angle between the base and the housing (as represented by the plane of its periphery) is 180°. Preferably, the cover should be manufactured so that the base and the housing define an angle less than 180° as indicated in phantom lines 12' in FIG. 4. This can be accomplished by a suitable shape of the flexure hinge (16). The hinge should preferably be resilient enough to allow at least partial recovery, or return to the initial state, upon deformation and release of the deforming force. Consequently, when the above-described cover is installed over a padlock by fastening the base (12) to a door (58), the resilience of the hinge (16) will cause the housing to abut and press against the door (58). When lifted e.g. by a hand (FIG. 1 or FIG. 2) and then released, the housing will again abut the door (58) along the periphery thus covering the padlock (56) with its shackle (70) and the staple (64) (and partly the hasp 60) from weather elements.

It will be appreciated that an integral hinge such as a living hinge usually affords better protection from precipitation than a standard hinge.

Although the invention has been disclosed with regard to particular and preferred embodiment, this is advanced for illustrative purposes only and is not intended to limit the scope of this invention. For instance, it may be possible to construct the protective cover structure from plastic, sheet metal, rubber, or other suitable materials affording certain pliability or flexibility, and resilience of the flexure hinge. Further, although depicted as rectangular in the drawings, the protective cover of this invention may be of different shape or configuration. Likewise, the term "door" as used herein in connection with the location in which the protective cover structure is to be used is not limited to doors but includes gates or any other surface. These variations remain within the spirit and scope of the invention as defined in the appended claims.

| | |
|---|---|
| 10. | Padlock protective cover |
| 12. | Base of the padlock protective cover |
| 14. | Housing of the padlock protective cover |
| 16. | Flexure hinge |
| 18. | First fastener bore |
| 20. | First fastener ledge |
| 22. | Second fastener bore |
| 24. | Second fastener ledge |
| 26. | First fastener |
| 28. | Second fastener |
| 30. | Housing ramp wall |
| 32. | Housing top wall |
| 34. | Housing back wall |
| 36. | Housing first side wall |
| 38. | Housing second side wall |
| 40. | First cutout-ready portion |
| 42. | Second cutout-ready portion |
| 44. | First ledge of the housing first side wall |

-continued

| | |
|---|---|
| 46. | Second ledge of the housing first side wall |
| 48. | First ledge of the housing second side wall |
| 50. | Second ledge of the housing second side wall |
| 52. | Ledge of the housing back wall |
| 54. | Ledge of the housing ramp wall |
| 56. | Padlock |
| 58. | Door |
| 60. | Hasp |
| 62. | Hasp |
| 64. | Staple |
| 66. | |
| 68. | |
| 70. | Shackle of the padlock |

The invention claimed is:

1. A protective cover for a padlock or the like that is mounted on a substrate such as a door or a similar structure and engages a staple to immobilize a hasp to the staple, the cover comprising:

a base having attachment means for attaching the base to the substrate in a vicinity of a padlock to be covered, a housing having a substantially planar periphery, the housing shaped and dimensioned to accommodate the padlock therein, and a resilient living hinge connecting the base and the housing to allow a substantially pivotal movement of the housing relative to the base, the resilience of said living hinge being sufficient for the housing to abut directly against the substrate along the planar periphery when the base is attached to said substrate and the housing extends at substantially 180° relative to said base.

2. The cover according to claim 1, wherein the housing comprises at least one cutout-ready portion disposed at the periphery of the housing at a position corresponding to the position of the hasp, to enable the user to form a custom cut-out sized to accommodate the hasp, so that in a closed position of the cover, the housing abuts the substrate along most of the periphery of the housing and spacing between said housing and said hasp is substantially eliminated.

3. The cover according to claim 1, wherein the living hinge is formed to define, in an unbiased, uninstalled position of the cover, an angle of less than 180° between the base and the housing.

4. The cover according to claim 2 wherein the cutout-ready portion has a thinned wall to facilitate removal of a selected part of the cutout-ready portion, the part corresponding to hasp dimensions.

5. The cover according to claim 2 wherein the cutout-ready portion has perforations or indentations to facilitate removal of a selected part of the cutout-ready portion, the part corresponding to hasp dimensions.

6. The cover according to claim 1 wherein the housing has ledges along the periphery thereof.

7. A protective cover for a padlock or the like that is mounted on a substrate such as a door or a similar structure and engages a staple to immobilize a hasp to the staple, the cover comprising:

a base having attachment means for attaching the base to the substrate in a vicinity of a padlock to be covered, a housing having a substantially planar periphery, the housing shaped and dimensioned to accommodate the padlock therein, the housing having two cutout-ready portions disposed at the periphery of the housing to enable formation of a selected cut-out at a position corresponding to the position of the hasp, the cut-out sized to fit the hasp so that in a closed position of the cover, the housing abuts the substrate along most of the periphery of the housing and spacing between said housing and said hasp is substantially eliminated, and a resilient living hinge connected to the base and to the housing to allow a substantially pivotal movement of the housing relative to the base, the resilience of the living hinge being sufficient to hold the housing directly against the substrate at substantially the entire periphery thereof when said base is secured to the substrate and said housing extends at substantially 180° relative to said base and covers the padlock.

* * * * *